US007871672B2

(12) United States Patent
Crook et al.

(10) Patent No.: US 7,871,672 B2
(45) Date of Patent: Jan. 18, 2011

(54) COMPOSITE PRESS FELT

(75) Inventors: Robert L. Crook, Wilson, NC (US); Senjay Patel, Summerville, SC (US); William Daniel Aldrich, Wilson, NC (US); Per Ola Lidar, Hästhagsvägen (SE)

(73) Assignee: Voith Patent GmbH, Heidenheim (DE)

( * ) Notice: Subject to any disclaimer, the term of this patent is extended or adjusted under 35 U.S.C. 154(b) by 205 days.

(21) Appl. No.: 10/550,476

(22) PCT Filed: Mar. 24, 2004

(86) PCT No.: PCT/EP2004/050359

§ 371 (c)(1),
(2), (4) Date: Aug. 7, 2006

(87) PCT Pub. No.: WO2004/085727

PCT Pub. Date: Oct. 7, 2004

(65) Prior Publication Data

US 2007/0003760 A1 Jan. 4, 2007

(30) Foreign Application Priority Data

Mar. 25, 2003 (GB) ..... 0306769.1

(51) Int. Cl.
*B05D 5/00* (2006.01)

(52) U.S. Cl. ..... 427/384; 427/365; 427/385.5; 427/389.9; 427/392; 427/394; 427/396

(58) Field of Classification Search ..... 427/384, 427/385.5, 389.9, 394, 365
See application file for complete search history.

(56) References Cited

U.S. PATENT DOCUMENTS

| | | | | | |
|---|---|---|---|---|---|
| 2,416,232 | A | * | 2/1947 | Soday | 427/341 |
| 3,772,746 | A | | 11/1973 | Ivanowicz | |
| 4,267,227 | A | | 5/1981 | Schiher et al. | |
| 4,357,386 | A | | 11/1982 | Luciano et al. | |
| 4,439,481 | A | * | 3/1984 | Johnson et al. | 442/271 |
| 4,446,187 | A | | 5/1984 | Eklund | |
| 4,529,643 | A | * | 7/1985 | Lundstrom | 442/275 |
| 4,569,883 | A | | 2/1986 | Renjilian | |
| 4,571,359 | A | | 2/1986 | Dutt | |
| 4,772,504 | A | | 9/1988 | Andresen | |
| 4,781,967 | A | * | 11/1988 | Legge et al. | 428/109 |

(Continued)

FOREIGN PATENT DOCUMENTS

EP 0653512 A2 5/1995

(Continued)

OTHER PUBLICATIONS

Annex to European Search Report EP 99 11 7832 Feb. 9, 2000.

(Continued)

*Primary Examiner*—Erma Cameron
(74) *Attorney, Agent, or Firm*—Taylor IP, P.C.

(57) ABSTRACT

There is provided an industrial fabric comprising a layer of batt of fibres optionally needled to a base cloth, whereby during manufacture of the fabric a dispersion of particulate, polymeric material has been applied to the layer of batt of fibres and thermally activated to provide a discontinuous layer containing a mixture of batt fibres and a polymer-baft fibre matrix.

27 Claims, 2 Drawing Sheets

10

U.S. PATENT DOCUMENTS

| | | | | | |
|---|---|---|---|---|---|
| 4,847,116 | A | * | 7/1989 | Duit | 427/195 |
| 4,851,281 | A | * | 7/1989 | Wood | 442/225 |
| 5,071,697 | A | | 12/1991 | Gulya et al. | |
| 5,187,005 | A | | 2/1993 | Stahle et al. | |
| 5,298,124 | A | * | 3/1994 | Eklund et al. | 162/306 |
| 5,346,516 | A | | 9/1994 | Alkhas et al. | |
| 5,346,932 | A | | 9/1994 | Takahashi et al. | |
| 5,508,094 | A | | 4/1996 | McCarthy et al. | |
| 5,585,161 | A | | 12/1996 | Difloe et al. | |
| 5,637,375 | A | | 6/1997 | Hohman | |
| 5,732,749 | A | * | 3/1998 | Fargeout | 139/383 AA |
| 5,789,052 | A | | 8/1998 | Miller et al. | |
| 5,925,221 | A | * | 7/1999 | Sayers et al. | 162/348 |
| 5,971,879 | A | | 10/1999 | Westhoff | |
| 6,017,583 | A | | 1/2000 | Gass | |
| 6,027,615 | A | * | 2/2000 | Davenport et al. | 162/358.2 |
| 6,036,819 | A | * | 3/2000 | Miller et al. | 162/358.2 |
| 6,337,112 | B1 | | 1/2002 | Watanabe et al. | |
| 6,455,448 | B1 | * | 9/2002 | Davenport et al. | 442/148 |
| 6,531,033 | B1 | * | 3/2003 | Kawashima | 162/306 |
| 6,648,147 | B1 | * | 11/2003 | Lydon et al. | 210/490 |
| 7,259,117 | B2 | | 8/2007 | Mater et al. | |
| 2004/0016473 | A1 | * | 1/2004 | Hansen | 139/391 |
| 2004/0126569 | A1 | * | 7/2004 | Davenport et al. | 428/327 |

FOREIGN PATENT DOCUMENTS

| | | | |
|---|---|---|---|
| EP | 0987366 | A2 | 3/2000 |
| GB | 2102731 | A | 2/1983 |
| GB | 2200687 | A | 8/1988 |

OTHER PUBLICATIONS

International Search Report PCT/EP2004/050359 Sep. 24, 2004.

* cited by examiner

10

10

COMPOSITE PRESS FELT

The present invention relates to a press felt for use in the press section of a papermaking machine.

Paper is conventionally manufactured by conveying a paper furnish, usually consisting of an initial slurry of cellulosic fibres, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder and then creped.

Papermachine clothing is essentially employed to carry the paper web through these various stages of the papermaking machine. In the forming section the fibrous furnish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. In the final stage, the paper web is transferred either to a Yankee dryer, in the case of tissue paper manufacture, or to a set of dryer cylinders upon which, aided by the clamping action of the dryer fabric, the majority of the remaining water is evaporated.

A conventional press fabric comprises a batt of fibres needled to a base fabric.

U.S. Pat. No. 4,847,116 and U.S. Pat. No. 4,571,359 relate to press fabrics in which a uniform layer of polymeric resin particles is applied to the surface of a woven textile base fabric. The resin particles are fused together to provide a porous elastic surface layer. A similar arrangement is described in EP 0653512A except in that a reinforcing structure, possibly a press felt, comprising a base cloth and a fibrous batt, is entirely embedded within the fused particulate material. These methods, involving sintering of fused particles, have limitations in practice as it is difficult to apply a large mass of particles of the required particle size, to a substrate and achieve controlled placement, porosity and application thickness.

U.S. Pat. No. 4,772,504 describes a substantially impermeable press felt, provided with a layer of plastics material on the paper contacting surface to act as an anti-rewet layer.

U.S. Pat. No. 6,017,583 relates to a process for the manufacture of a permeable strip material in which a plastics layer comprising soluble corpuscles is applied to a support and the soluble corpuscles are then leached out to provide through-flow passages. The plastics layer is initially applied as a powder and forms a planar outer surface plastic layer by heat and pressure treatment.

GB 2,200,687 describes the addition of additives to the needled batt layer of press felts in order to maximise the coated area between the press felt and the paper web. Such felts, when in use, are prone to rapid wear and a drastic reduction in felt porosity.

U.S. Pat. No. 4,357,386 relates to a papermaker's press felt made up of a textile base layer, an intermediate layer of polymeric resin foam particles and a covering layer of non-woven staple fibres. The foam particles are included to improve wear and delamination, as well as to increase water removal capabilities. These particles, which are 0.3 to 2 cm in diameter are not melted but are instead consolidated into the felt by needling.

EP 0987366A2 relates to a press felt in which a fibrous batt is needled to a woven base fabric. A substantially smooth and substantially uniformly porous layer is applied to the batt. This layer may comprise a woven fabric, a porous film sheet or a porous film obtained by heating a layer of at least partially fusible powder material.

According to the present invention there is provided a industrial fabric comprising layer(s) of batt of fibres optionally needle punched to a base cloth, characterised in that during manufacture of the fabric a dispersion of particulate, polymeric material has been applied to the layer and thermally activated to provide a discontinuous layer containing a mixture of batt fibres and a polymer-batt fibre matrix. Solid polymer particles being applied as a dispersion remain discrete so that the polymer/fiber matrix structure remains permeable while improving surface smoothness, wear resistance and compaction resistance.

According to the invention the discontinuous layer containing a mixture of batt fibres and a polymer-batt fibre matrix is not only creating the surface of the fabric but also extends vertically into the fabric. Therefore the discontinuous layer exists in the x, y and z direction within the batt structure.

Further the polymeric layer formed is discontinuous, what means that there is no continuous matrix layer formed embedding the batt fibres. It is to be understood that the polymeric material in the discontinuous layer wets and impregnates the batt material only partially thereby creating areas in the layer which are not occupied with said polymeric material.

Preferably the polymeric material impregnates the fibres along the axes of the fibres.

The thermal activation may comprise, for example, heating or applying incident radiation.

The resin-batt fibre matrix would comprise batt material with "cells" of polymer adhered to the surrounding fibres.

The industrial fabric according to the invention preferably is a paper machine clothing, whereby the paper machine clothing can be a forming fabric, a press felt, a dryer fabric or the like.

The industrial fabric can have a woven or an non-woven base cloth which is linked with the batt fibres.

It has been discovered that a significant impact on the fibre web structure can be realised using this technology with relatively small quantities of particles preferably in the range from 0.1% to 20% weight add on, most preferably in the range from 1% to 5% weight add on. This is important in providing process consistency, and is also much more cost effective than prior art methods. Multiple applications using relatively small amounts of particulate material in each pass, may be used to provide uniformity of surface.

To increase the performance in dynamic properties of the industrial fabric and to increase the durability of the industrial fabric the particulate polymeric material preferably can comprise thermoplastic elastomer particles.

The resiliency and the wear resistance of the material is an important consideration. Elastomeric polyurethane is having excellent wear resistance and resiliency.

Surprisingly, the industrial fabric of the invention exhibits excellent resiliency, a smoother more planar surface and excellent abrasion resistance. Further the industrial fabric according to the invention is much easier to clean compared to fabrics known in the art.

Due to the discontinuous cellular structure of the added polymer, permeability and porosity remain high depending on the total solid add-on on a given substrate structure.

In the case that the industrial fabric is a paper machine clothing the fabric according to the invention further has an enhanced performance in sheet dewatering and rewet reduction.

In the case that the industrial fabric according to the invention is a press felt a enhanced uniform pressing interface for the paper web is achieved, particularly when under pressure, for example at a press nip.

The paper machine clothing according to the invention further exhibits excellent wear resistance, pressure uniformity, and air and water permeability.

The industrial fabric in accordance with the invention further exhibits excellent batt fibre bonding.

The industrial fabric may be made by depositing particles of polymeric material, optionally in combination with one or more binding agents, viscosity modifiers, anti-settling agents and/or wetting agents, into the fibrous fabric surface. The water is removed whilst the binder holds the particles in position. The modified surface is then heated in order to soften the particulate matter, whereupon the particulate material undergoes at least partial flow and fuses to itself as well as to the batt fibres and any matter in the vicinity. The resulting partially fused surface layer may then be calendered. E.g. in the case of an elastomeric polyurethane, the particles will thermally bond to each other and flow along the fibre axes thereby bonding the adjacent fibres. Consequently flow channels and porosity are maintained in the press felt structure and on its surface. Therefore the industrial fabric according to the invention surprisingly has approximately the same permeability as the fabric before applying the discontinuous layer.

The particles are ideally supplied as a suspension in a liquid, preferably water. The polymeric dispersion can be applied by a kiss roll or as a foam in which case a foaming agent is included in the formulation or by a pre-cast thermoset film. Blade coating/spray techniques or electrostatic technique may also be used.

According to a second aspect of the present invention there is provided a method of making a industrial fabric in which a dispersion of particulate, polymeric material is applied to a batt of fibres, the batt being optionally needled to a base cloth, the particulate material then being thermally activated to bond the particulate material to the fibres and provide layer containing polymeric material and fibres.

According to a preferred embodiment of the method a discontinuous layer is formed containing a mixture of batt fibres and a polymer-batt fibre matrix.

According to another embodiment of the method a continuous polymer-batt fibre matrix layer is formed.

The method of the invention may be used to introduce any particulate (organic and/or inorganic) matter to a industrial fabric. Organic and/or inorganic matter could be mono/poly dispersed in the particulate matter, as could micro-fibres, bicomponent and/or splittable fibres, carbon fibres, nanoparticles, alloys or blends of polymeric materials, and/or hollow micro-spheres. The polymeric material may be thermoplastic or thermoset. Multiple particle sizes and/or multiple types of particles having different hardnesses and melting points may be used to create unique surface and drainage effects. Additional micro-fibres are preferably added to the particulate material in that they aid bonding and they give the structure multi-directional strength and so reinforce the structure by enabling the layers of particulate matter to become more securely bonded to one another and to the batt fibres. The micro-fibres may be selected to have complex surface striations/morphology and may have a selected material property so as to facilitate wicking of moisture away from the paper web. This might also be achieved with a surface network or with micro-particles. Inorganic materials may be useful for static control and in providing sensor triggers for on-machine monitoring devices. Very hard or conductive inorganic particles, or time release capsules (such as are described in U.S. Pat. No. 4,569,883) with surfactants or tracer material, etc. can be added utilising this technology.

The polymeric material preferably can comprise thermoplastic elastomers e.g. polyurethane (TPU). These particles will disperse and penetrate into the batt structure depending on the selected batt fineness and stratification, particle sizes and concentration, dispersion viscosity, temperature, use of vacuum, etc.

To form a porous structure (discontinuous layer) from 0.1 to 20% weight add on of polymeric material is preferably applied. Most preferably from 1% to 5% weight add on of polymeric material is applied. This is insufficient to form a continuous sheet layer. We would estimate that more than 20% weight add on would be required to form a continuous layer e.g. for a belt.

The diameter of the particles of the polymeric material is preferably in the range from 0.1 to 600 microns, most preferably in the range from 1 to 300 microns and ideally in the range from 20 to 150 microns.

The dispersion ideally comprises at least one binder to hold the particles in place on a given substrate e.g. the batt fibres of the fabric.

Bonding to the batt fibres is achieved via the binder system. The binder could be in liquid or solid form. The binder might be a permanent chemical adhesive. The binder is preferably included in an amount of 0.05% to 2%, most preferably 0.1-0.5% based on the dispersion volume. If the binder is in particulate form, then its melting point should be lower than that of the other particles and of the, typically polyamide, batt fibre. Preferred binders include any of the following either alone or in combination:—co-polyamides, co-polyesters, PVA's, PU's and nitrile latex rubbers.

The particulate dispersion ideally comprises at least one viscosity modifier to suit processing methods and equipment. Preferred viscosity modifiers include any of the following either alone or in combination:—Neutonian, Pseudo-plastic and/or strongly pseudo plastic types, based on PU, acrylic or PA's for water-borne systems. Guar and natural gums can also be used. The viscosity modifier is preferably included in an amount of 0.05% to 5%, most preferably 0.1% to 2% based on the dispersion volume.

The particulate dispersion may include one or more anti-settling agents. Typical water soluble anit-settling agents are polyamides, polyacrylates and polyurethanes. The particulate dispersion preferably comprises from 0.1-2% of anti-settling agent and, more preferably from 0.2-0.25% based on the dispersion volume.

The particulate dispersion may also include one or more wetting agents. Typical wetting agents include surfactants, ethoxylated ethers. The wetting agent is added in order to improve the wetting of the particles by lowering the surface tension. The particulate dispersion preferably comprises from 0.05% to 2% of wetting agent and, more preferably from 0.05-0.25% based on the dispersion volume.

All of the components described above are selected such that the overall system is compatible with the relevant substrate.

Typically, any type of endless or seamed base can be used as the substrate. Alternatively, it may be the case that the combination of the binding particles and the polyamide non-woven fibres alone may provide sufficient strength and stability, so that a standard textile type base can be omitted. The surface structure is preferably needle punched fibrous nonwoven, but could be any other non-woven as well such as point bonded, spun bonded, etc.

Particles bonded to the surface of typically round fibres and yarns may provide surprising influences on improving or controlling water or air flow and/or sheet release at extremely high speeds anticipated for newer generation of paper machines.

In a preferred embodiment of the invention a complex, unique composite matrix is created using a relatively coarse nonwoven staple fibre. These fibres are bonded together using polymeric particles for increased long-term resiliency and also improved fibre bonding and strength. Nearer the surface an application of finer, perhaps harder particles can be made, interbonded with each other, the polyamide fibres and the interior particles to form a resilient interconnected network with a high degree of overall uniformity on the pressing surface, while still providing excellent porosity for sheet dewatering, and a far tougher surface, immune to fibre shedding than is achievable with fine diameter staple fibres.

Application of the dispersion could also be on the interior roll side surface as well to make the fabric tough and resist high degree of inside wear for certain applications.

In order that the present invention may be more readily understood, specific embodiments will now be described with reference to the accompanying representations in which:—

DETAILED DESCRIPTION OF THE INVENTION

Figure 1:
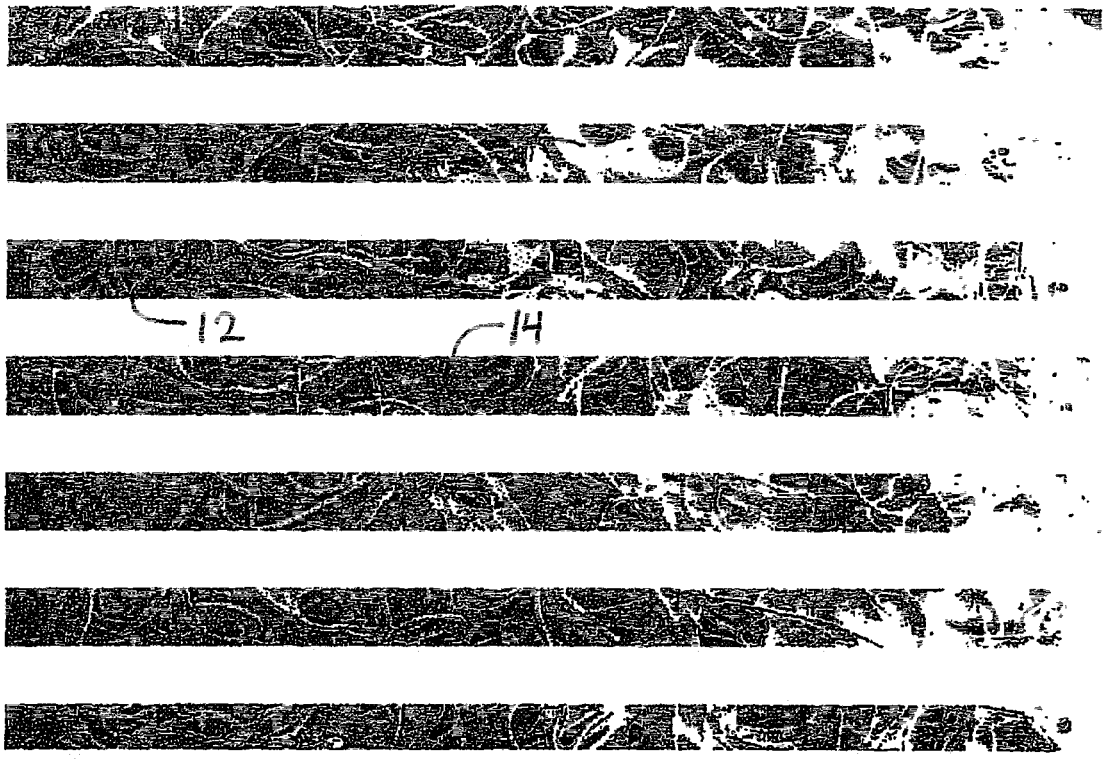
FIG. 1 is an SEM of the surface of one press felt in accordance with the invention at 10× magnification.

Referring now to the drawings, and more particularly to FIG. 1, there is shown a press felt 10 which generally includes fibres 12 of a batt of fibres and a polymer-batt fibre matrix 14.

Example 1

A press felt was manufactured by needling a batt of polyamide fibres to a woven base cloth.

A particulate dispersion was prepared, the constituents of which are listed below.

9 g/l—viscosity modifier 5 g/l—binder 78.75 g/l—polyurethane particles (20-150 microns in diameter)

water

The viscosity modifier, binder and polyurethane particles were added to the water to provide the particulate dispersion. The dispersion was then applied by a kiss roll method. This was applied in multiple revolutions, leading to uniformity of the particulate matter within the felt/batt fibre surface. The treated fabric was then dried for example by hot air or infrared radiation.

The treated fabric was then heated to the softening temperature of the polyurethane particles. Whilst the particulate material is in a quasi-molten state, the fabric surface was compacted using a compaction roll which pushed the material in to the interstices within the batt, whilst also smoothing the fabric surface. This results in a porous, composite with high resiliency and a smooth surface.

Tests have proven that the press fabric made in this way provides increased smoothness in the nip, thus reducing the possibility of marking of the paper web.

In the following examples a press felt was treated in like manner to Example 1.

Example 2

Dispersion Formulation 1 g/l—wetting agent 100 g/l—polyurethane particles (50-150 microns in diameter)

2.4 g/l—anti settling agent 1

1.6 g/l—anti settling agent 2

5 g/l—viscosity modifier 1

2 g/l—viscosity modifier 2

2.5 g/l—binder water

The above were all applied using a kiss roll applicator.

Figure 2:
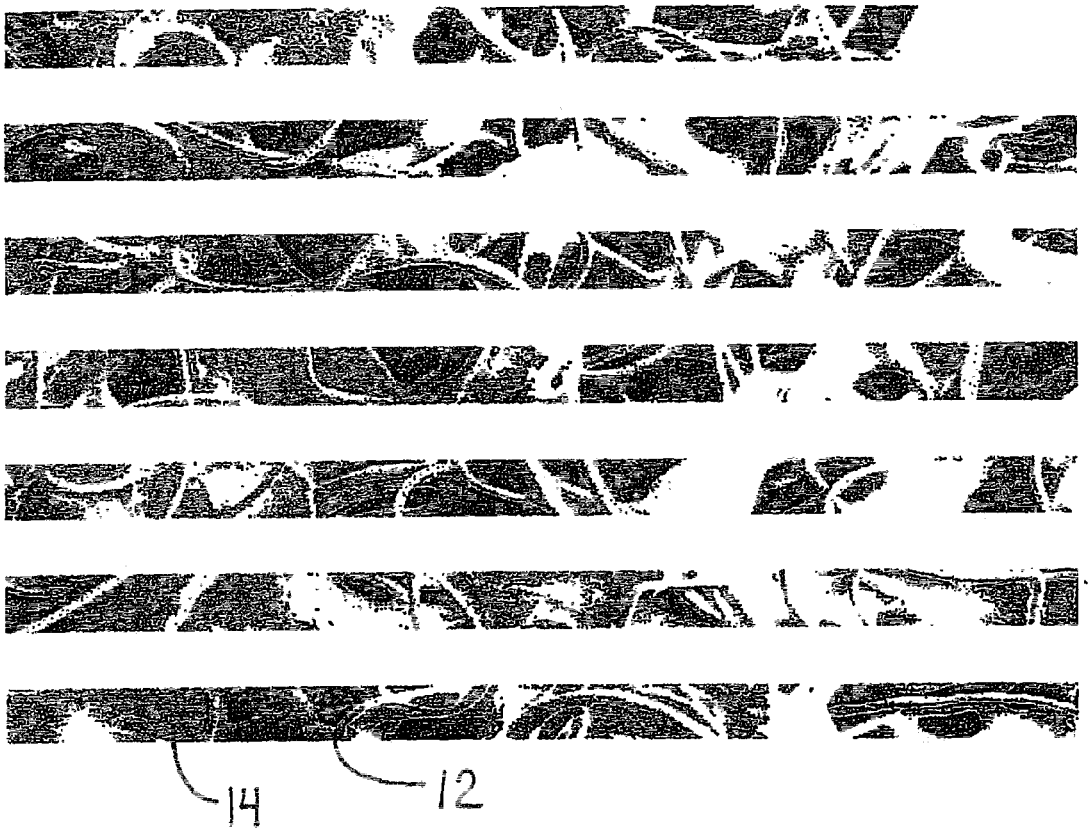
FIG. 2 is an SEM of the same surface at 20× magnification.
Figure 1:
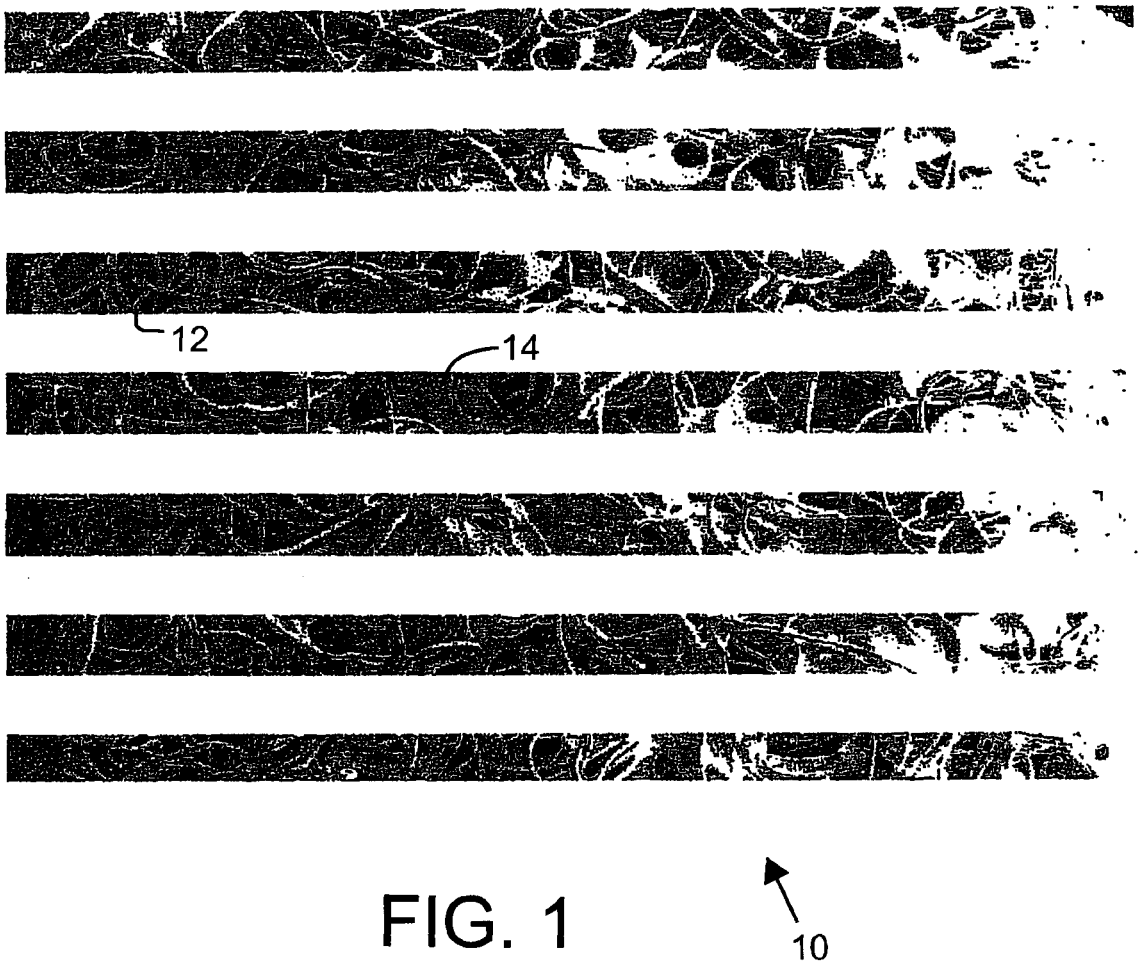
Figure 2:
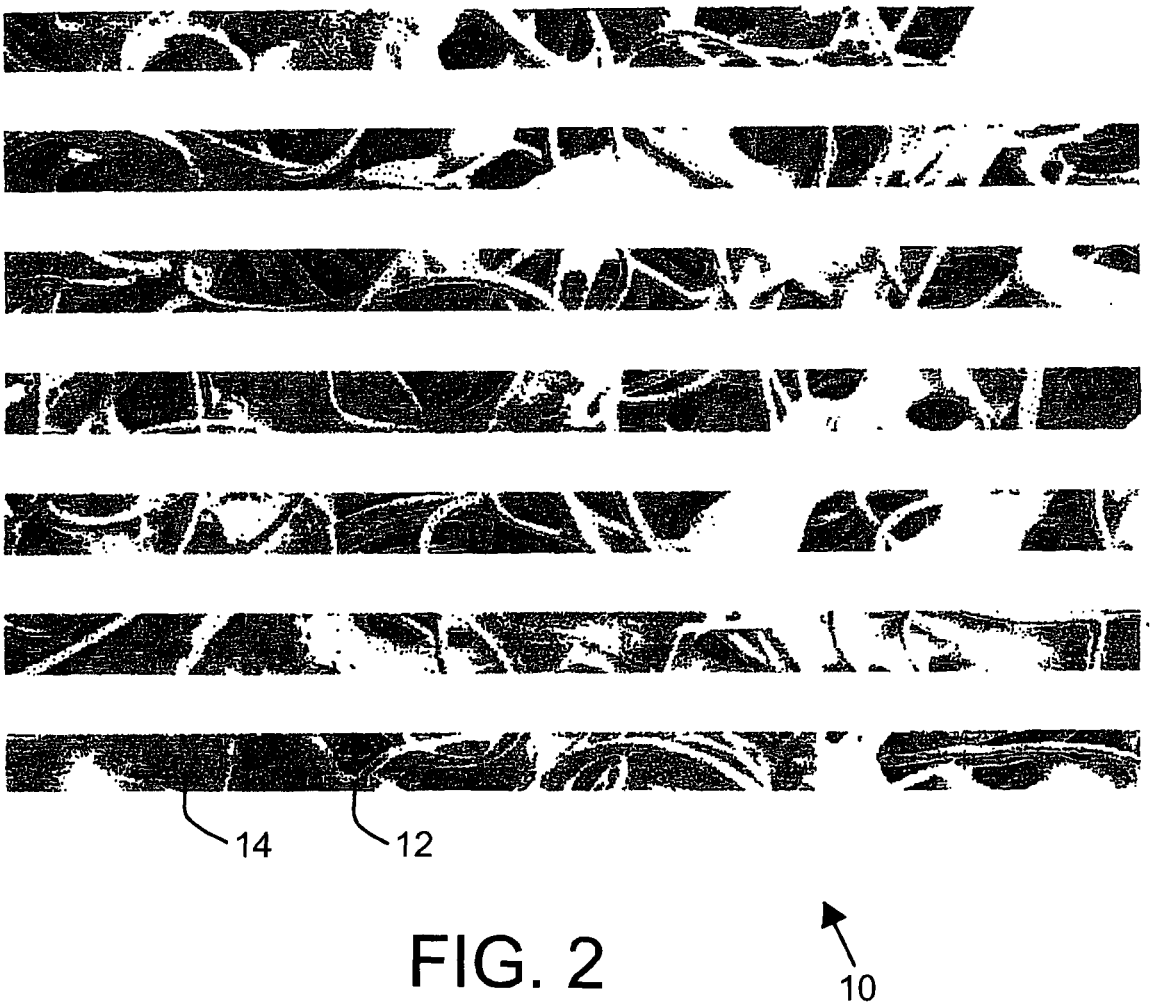

The photographs of FIGS. 1 and 2 show that the particulate material is melted (and not sintered) and is present as a non-continuous treatment. The melted thermoplastic material fills the interstices between the batt fibres, whilst fusing around the batt. The treatment fills the undulations in the batt to give a smoother and more planar surface, after calendering, which does not close down the permeability of the fabric.

It is to be understood that the above described examples may be subject to various modifications.

The invention claimed is:

1. A method of making an industrial fabric comprising the following steps: applying a dispersion of particulate polymeric material to a batt of fibres, thermally activating the dispersion of particulate polymeric material and thereby softening the particulate polymeric material such that the particulate polymeric material undergoes at least partial flow and fuses to itself and to the batt of fibres; wherein the activated dispersion of particulate polymeric material results in a layer which forms the surface of the industrial fabric and which includes the activated dispersion of particulate polymeric material extending vertically within the batt of fibres, the industrial fabric being a press felt of a papermaking machine, the layer being a discontinuous layer containing a mixture of batt fibres and a polymer-batt fibre matrix.

2. The method according to claim 1, wherein more than 20% weight add on of the polymeric material is applied.

3. The method according to claim 1, wherein 0.1% to 20% weight add on of the polymeric material is applied.

4. The method according to claim 1, wherein a diameter of the polymeric particles applied is in the range from 0.1 to 600 microns.

5. The method according to claim 1, wherein the dispersion comprises at least one binder, and wherein the binder is in liquid and/or solid form.

6. The method according to claim 5, wherein the binder is at least one of co-polyamides, co-polyesters, polyvinyl acetate, polyurethane and nitrile latex rubbers.

7. The method according to claim 5, wherein the binder is included in an amount of 0.05% to 2% based on the dispersion volume.

8. The method according to claim 5, wherein the binder is included in an amount of 0.1% to 0.5% based on the dispersion volume.

9. The method according to claim 1, wherein the dispersion comprises at least one viscosity modifier.

10. The method according to claim 9, wherein the viscosity modifier is at least one of (a) Neutonian, (b) Pseudo-plastic, (c) pseudo plastic types based on polyurethane, acrylic, or polyamide for water-borne systems, and (d) guar or natural gums.

11. The method according to claim 9, wherein the viscosity modifier is included in an amount of 0.05% to 5% based on the dispersion volume.

12. The method according to claim 9, wherein the viscosity modifier is included in an amount of 0.1% to 2% based on the dispersion volume.

13. The method according to claim 1, wherein the dispersion comprises at least one anti-settling agent.

14. The method according to claim 13, wherein the anti-settling agent is water soluble and further comprises at least one of a polyamide, polyacrylate and polyurethane.

15. The method according to claim 14, wherein the anti-settling agent is included in an amount of 0.1% to 2% based on the dispersion volume.

16. The method according to claim 14, wherein the anti-settling agent is included in an amount of 0.2% to 0.25% based on the dispersion volume.

17. The method according to claim 1, wherein the dispersion comprises at least one wetting agent.

18. The method according to claim 17, wherein the wetting agent includes one of (a) a surfactant which is not ethoxylated ether, and (b) ethoxylated ether.

19. The method according to claim 17, wherein the wetting agent is included in an amount of 0.05% to 2% based on the dispersion volume.

20. The method according to claim 17, wherein the wetting agent is included in an amount of 0.05% to 0.25%, based on the dispersion volume.

21. The method according to claim 12, further comprising the step of calendaring the fabric.

22. The method of making an industrial fabric of claim 1, further comprising the step of needling the batt to a base cloth.

23. The method of making an industrial fabric of claim 1 wherein the thermal activation of the dispersion of particulate polymeric material bonds the particulate material to the fibres.

24. The method according to claim 1, wherein 1% to 5% weight add on of the polymeric material is applied.

25. The method according to claim 1, wherein a diameter of the polymeric particles applied is in the range from 1 to 300 microns.

26. The method according to claim 1, wherein a diameter of the polymeric particles applied is in the range from 20 to 150 microns.

27. The method according to claim 1, wherein the step of thermally activating includes at least one of heating and applying incident radiation to the dispersion of particulate polymeric material.

* * * * *

UNITED STATES PATENT AND TRADEMARK OFFICE

CERTIFICATE OF CORRECTION

PATENT NO. : 7,871,672 B2
APPLICATION NO. : 10/550476
DATED : January 18, 2011
INVENTOR(S) : Robert L. Crook et al.

It is certified that error appears in the above-identified patent and that said Letters Patent is hereby corrected as shown below:

Delete title page showing an illustrative figure and substitute the attached title page therefor.

DRAWING SHEETS

Please replace Drawing Sheet 1 of 2 and Drawing Sheet 2 of 2 with the attached Formal Drawings.

COLUMN 8

At line 7, please delete "claim 12,", and substitute therefore --claim 1,--.

Signed and Sealed this
Twenty-ninth Day of November, 2011

David J. Kappos

David J. Kappos
*Director of the United States Patent and Trademark Office*

(12) United States Patent
Crook et al.

(10) Patent No.: US 7,871,672 B2
(45) Date of Patent: Jan. 18, 2011

(54) COMPOSITE PRESS FELT

(75) Inventors: Robert L. Crook, Wilson, NC (US); Senjay Patel, Summerville, SC (US); William Daniel Aldrich, Wilson, NC (US); Per Ola Lidar, Hästhagsvägen (SE)

(73) Assignee: Voith Patent GmbH, Heidenheim (DE)

( * ) Notice: Subject to any disclaimer, the term of this patent is extended or adjusted under 35 U.S.C. 154(b) by 205 days.

(21) Appl. No.: 10/550,476

(22) PCT Filed: Mar. 24, 2004

(86) PCT No.: PCT/EP2004/050359

§ 371 (c)(1),
(2), (4) Date: Aug. 7, 2006

(87) PCT Pub. No.: WO2004/085727

PCT Pub. Date: Oct. 7, 2004

(65) Prior Publication Data

US 2007/0003760 A1 Jan. 4, 2007

(30) Foreign Application Priority Data

Mar. 25, 2003 (GB) ..... 0306769.1

(51) Int. Cl.
*B05D 5/00* (2006.01)

(52) U.S. Cl. ..... 427/384; 427/365; 427/385.5; 427/389.9; 427/392; 427/394; 427/396

(58) Field of Classification Search ..... 427/384, 427/385.5, 389.9, 394, 365
See application file for complete search history.

(56) References Cited

U.S. PATENT DOCUMENTS

| | | | | | |
|---|---|---|---|---|---|
| 2,416,232 | A | * | 2/1947 | Soday | 427/341 |
| 3,772,746 | A | | 11/1973 | Ivanowicz | |
| 4,267,227 | A | | 5/1981 | Schiber et al. | |
| 4,357,386 | A | | 11/1982 | Luciano et al. | |
| 4,439,481 | A | * | 3/1984 | Johnson et al. | 442/271 |
| 4,446,187 | A | | 5/1984 | Eklund | |
| 4,529,643 | A | * | 7/1985 | Lundstrom | 442/275 |
| 4,569,883 | A | | 2/1986 | Renjilian | |
| 4,571,359 | A | | 2/1986 | Dutt | |
| 4,772,504 | A | | 9/1988 | Andresen | |
| 4,781,967 | A | * | 11/1988 | Legge et al. | 428/109 |

(Continued)

FOREIGN PATENT DOCUMENTS

EP 0653512 A2 5/1995

(Continued)

OTHER PUBLICATIONS

Annex to European Search Report EP 99 11 7832 Feb. 9, 2000.

(Continued)

*Primary Examiner*—Erma Cameron
(74) *Attorney, Agent, or Firm*—Taylor IP, P.C.

(57) ABSTRACT

There is provided an industrial fabric comprising a layer of batt of fibres optionally needled to a base cloth, whereby during manufacture of the fabric a dispersion of particulate, polymeric material has been applied to the layer of batt of fibres and thermally activated to provide a discontinuous layer containing a mixture of batt fibres and a polymer-baft fibre matrix.

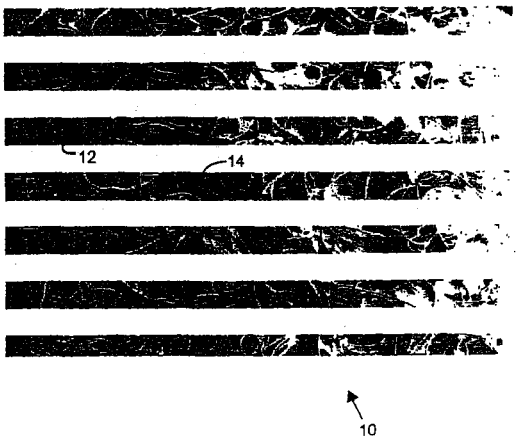

27 Claims, 2 Drawing Sheets